US008590114B2

(12) United States Patent
Shindo

(10) Patent No.: US 8,590,114 B2
(45) Date of Patent: Nov. 26, 2013

(54) WATCH BAND AND WRISTWATCH

(75) Inventor: Takayuki Shindo, Kodaira (JP)

(73) Assignee: Casio Computer Co., Ltd, Tokyo (JP)

( * ) Notice: Subject to any disclaimer, the term of this patent is extended or adjusted under 35 U.S.C. 154(b) by 263 days.

(21) Appl. No.: 13/116,240

(22) Filed: May 26, 2011

(65) Prior Publication Data

US 2011/0309116 A1 Dec. 22, 2011

(30) Foreign Application Priority Data

Jun. 18, 2010 (JP) ..... 2010-139055

(51) Int. Cl.
*A44C 5/00* (2006.01)

(52) U.S. Cl.
USPC ..... 24/71 J; 24/163 R; 24/178; 24/188; 224/164

(58) Field of Classification Search
USPC ..... 24/163 R, 178, 188, 71 J; 368/281, 282, 368/287; 224/164, 167, 180
See application file for complete search history.

(56) References Cited

U.S. PATENT DOCUMENTS

| | | | | | |
|---|---|---|---|---|---|
| 1,478,659 | A * | 12/1923 | King | 24/178 |
| 1,569,507 | A * | 1/1926 | Lederer | 24/178 |
| 1,704,795 | A * | 3/1929 | Heileman | 24/265 WS |
| 2,089,638 | A * | 8/1937 | Becker | 24/265 WS |
| 3,735,455 | A * | 5/1973 | Hauser | 24/191 |
| 4,086,756 | A * | 5/1978 | Drake | 368/10 |
| 4,546,522 | A * | 10/1985 | Gygax | 24/71 J |
| 4,858,283 | A * | 8/1989 | Takeuchi | 24/178 |
| 5,398,218 | A * | 3/1995 | Munnier et al. | 368/282 |
| 6,408,490 | B1 * | 6/2002 | Pequignet | 24/265 WS |
| 6,655,832 | B2 * | 12/2003 | Bach et al. | 368/282 |
| 6,762,976 | B1 * | 7/2004 | Tamaru et al. | 368/88 |
| 7,249,398 | B2 * | 7/2007 | Roy | 24/265 B |
| 2010/0309755 | A1 * | 12/2010 | Kitahara et al. | 368/282 |

FOREIGN PATENT DOCUMENTS

| | | |
|---|---|---|
| CN | 2707075 | 7/2005 |
| JP | 2006-212107 | 8/2006 |

OTHER PUBLICATIONS

State Intellectual Property Office of the People's Republic of China Notification of the First Office Action for Patent Application No. 201110168750.6 Dated Apr. 3, 2013, 18 pgs.

* cited by examiner

*Primary Examiner* — Robert J Sandy
*Assistant Examiner* — David Upchurch
(74) *Attorney, Agent, or Firm* — Turocy & Watson, LLP

(57) ABSTRACT

A watch band with a buckle which does not slip off from a band body thereof even when it gets a great shock, for example from collision with an object due to dropping thereof, and a wristwatch with such band. The band body has a pair of spaced attaching parts provided at an end thereof. An engaging member has a connection part connected through a connection pipe to between these attaching parts. A buckle has a pair of arms which hold these attaching parts therebetween. A pair of screws have a thread portion screwed into a screw hole in the end portion of an associated arm of the buckle and a shank part inserted in a nearer end portion of the connection pipe to attach the buckle to the band body so as not to slip off from the connection pipe even when the buckle gets a great shock.

7 Claims, 6 Drawing Sheets

WATCH BAND AND WRISTWATCH

CROSS REFERENCE TO RELATED APPLICATION

This application is based on Japanese Patent Application No. 2010-139055 filed on Jun. 18, 2010 and including specification, claims, drawings and summary. The disclosure of the above Japanese patent application is incorporated herein by reference in its entirety.

BACKGROUND OF THE INVENTION

1. Field of the Invention

This invention relates to a watch band and a wristwatch with the watch band.

2. Description of the Background Art

JP 2006-212107 discloses a watch band which includes a pair of band bodies attached to opposite sides of a watch case, a frame-shaped buckle having a pair of arms attached to an end of one of the band bodies so as to hold the band end therebetween, a pin extending from a midpoint of the band end to near a midpoint of a base portion of the buckle and a spring rod secured to the band end for attaching the buckle and the pin rotatably to the band end.

In this band, a roller is provided rotatably between the buckle arms. Thus, when an end portion of the other band body is inserted into the buckle, it is arranged to contact the roller to rotate same such that the other band body can be inserted smoothly into the buckle.

In this watch band, however, the buckle and the pin are attached by the spring rod to the end of the one band body. Thus, when a wristwatch case with the band bodies attached thereto is dropped from a height such as, for example, an about-10-m-high story of a building, the arms of the frame-shaped buckle would collide with an object such as the ground, get a great shock from it, and are moved away from each other to come off from the spring rod although such event may not occur when the wristwatch case with the band bodies is dropped from a low height, for example, of about 1 m.

It is therefore an object of the present invention to provide a watch band and a wristwatch with such band in which the buckle does not slip off from the band body even when it gets a great shock from collision with an object such as the ground due to dropping of the wristwatch with the band.

SUMMARY OF THE INVENTION

In one aspect, the present invention provides a watch band comprising a band body with a pair of spaced attaching parts, each having a through hole, provided at an end of the band body such that the through holes in the pair of attaching parts align with each other; a frame-shaped buckle having a pair of spaced arms disposed so as to hold the pair of attaching parts therebetween, the arms each having a through screw hole in an end portion of that arm with the through screw holes aligning with the through holes in the pair of attaching parts; an engaging member disposed between the pair of attaching parts, the engaging member protruding in the longitudinal direction of the band body, the engaging member having a though hole aligning with the through holes in the pair of attaching parts; a connection pipe inserted through the through holes in the pair of attaching parts and through the through holes in the engaging member for attaching the engaging member to the band body; and a pair of screws for attaching the buckle to the band body, each screw having a head exposed outside from a screw hole in an end portion of an associated one of the pair of arms of the buckle, a thread portion screwed into the screw hole in the end portion of the associated arm of the frame-shaped buckle and a shank part inserted rotatably in the connection pipe.

In another aspect, the present invention provides a watch band comprising a band body with a pair of spaced attaching parts, each having a through hole, provided at an end of the band body such that the through holes in the pair of attaching parts align with each other; a frame-shaped buckle having a pair of spaced arms disposed so as to hold the pair of attaching parts therebetween, the arms each having a through screw hole in an end portion of that arm with the through screw holes aligning with the through holes in the pair of attaching parts; an engaging member disposed between the pair of attaching parts, the engaging member protruding in the longitudinal direction of the band body, the engaging member having a though hole aligning with the through holes in the pair of attaching parts; a connection pipe inserted through the through holes in the pair of attaching parts and through the through holes in the engaging member for attaching the engaging member to the band body; and a pair of screws for attaching the buckle and the engaging member to the band body, each screw having a head exposed outside from a screw hole in an end portion of an associated one of the pair of arms of the buckle, a thread portion screwed into the screw hole in the end portion of the associated one of arms of the frame-shaped buckle and a shank part inserted rotatably into the though holes of the pair of attaching parts and the through hole of the engaging member.

According to this invention, even when the wristwatch with the band bodies is dropped from a high height and the buckle gets a great shock from collision with an object, thereby causing the arms of the buckle to move away from each other, the shank parts of the screws screwed into the arms of the buckle do not slip off from same.

Other objects, advantages, and features of the present invention will be apparent from the following detailed description of preferred embodiments.

DETAILED DESCRIPTION OF THE INVENTION

Embodiment 1

Figure 1:
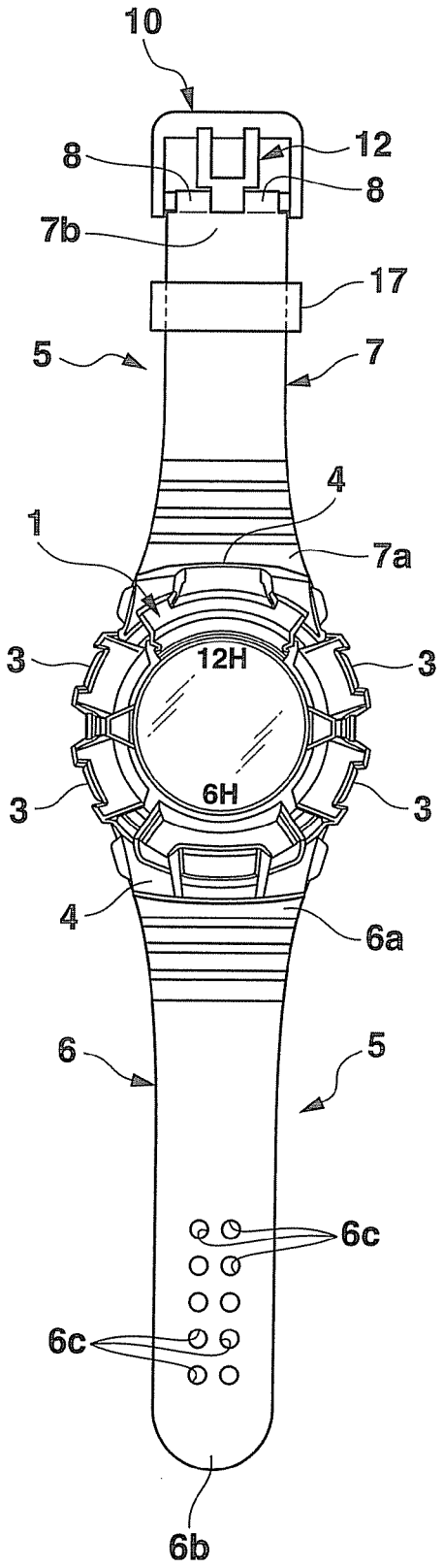
FIG. 1 is a front view of a wristwatch of an embodiment 1 of this invention.
Figure 2:
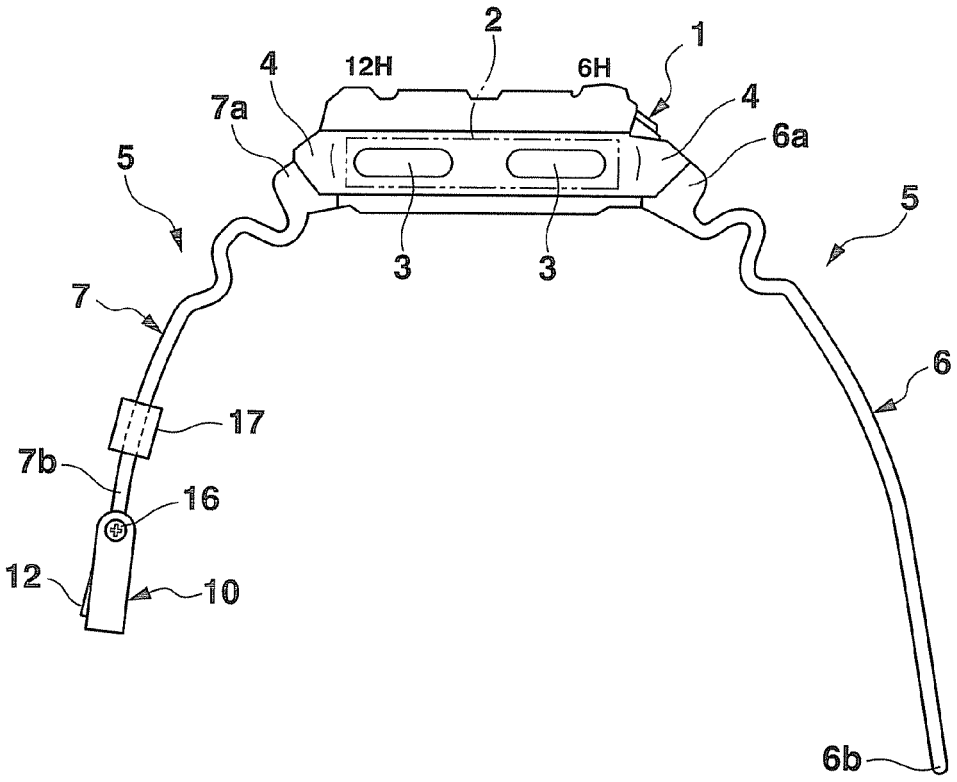
FIG. 2 is a side view of the wristwatch of FIG. 1.

Referring to FIGS. 1-5, the embodiment 1 of the wristwatch of this invention will be described. As shown in FIGS. 1 and 2, the wristwatch 1 has a case 1 which encases a timepiece module 2 therein, which in turn comprises various parts necessary for performing the timepiece function such as rotating hands indicating time and a display which displays time.

As shown in FIGS. 1 and 2, the case 1 has a pair of button switches 3 on each of the 3 and 9 time o'clock sides of the case 1. The case 1 has a pair of band attaching parts 4 provided respectively on the 12 and 6 o'clock sides thereof to which a band 5 is attached at its respective ends to wear the wristwatch on a user's wrist.

As shown in FIGS. 1 and 2, the band 5 includes a band body 6 attached at one end 6*a* (or an upper end in FIG. 1) to the attaching part 4 of the case 1 on the 6 o'clock side and a band body 7 attached at one end 7*a* to the attaching part 4 of the case 1 on the 12 o'clock side. The band bodies 6 and 7 are made of a plastic resin having a resiliency similar to that of rubber.

As shown in FIG. 1, the band body 6 also has a row of pairs of engaged eyelets 6*c* arranged longitudinally at equal intervals in a free (or lower) end portion 6*b* thereof.

Figure 3:
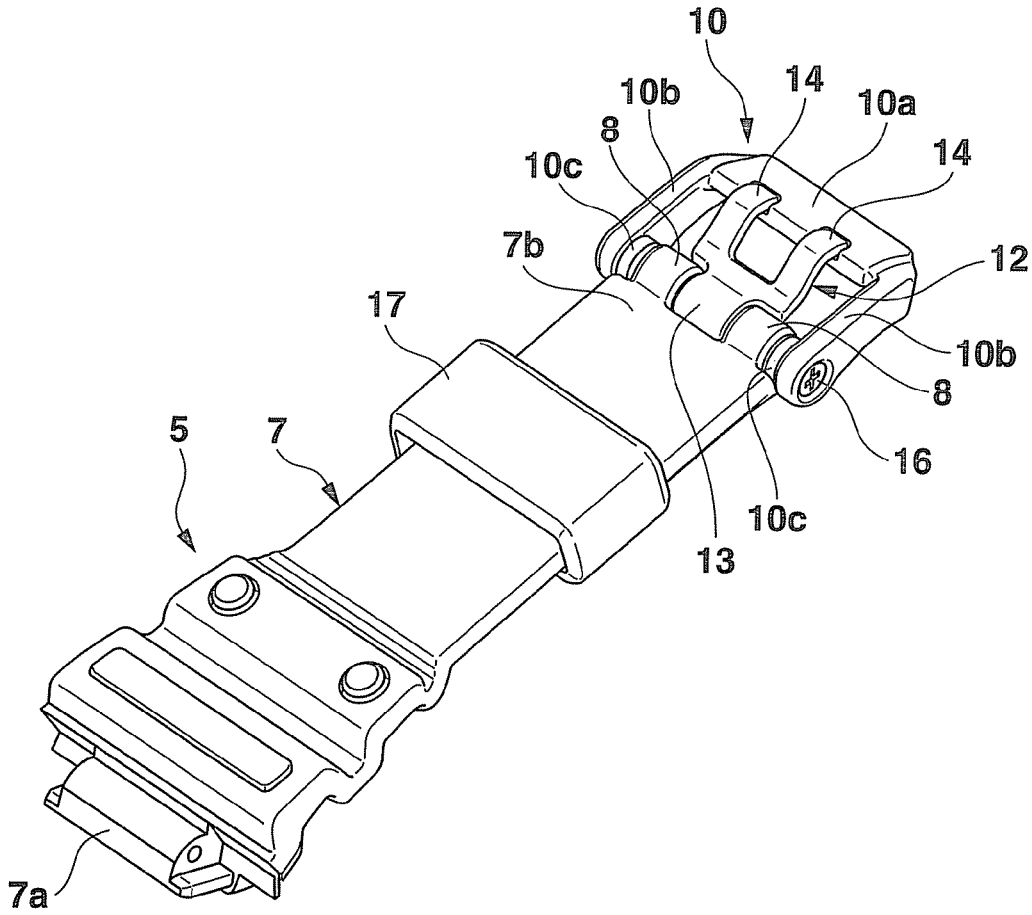
FIG. 3 is an enlarged perspective view of a watch band provided on a 12 o'clock side of the wristwatch of FIG. 1.
Figure 4:
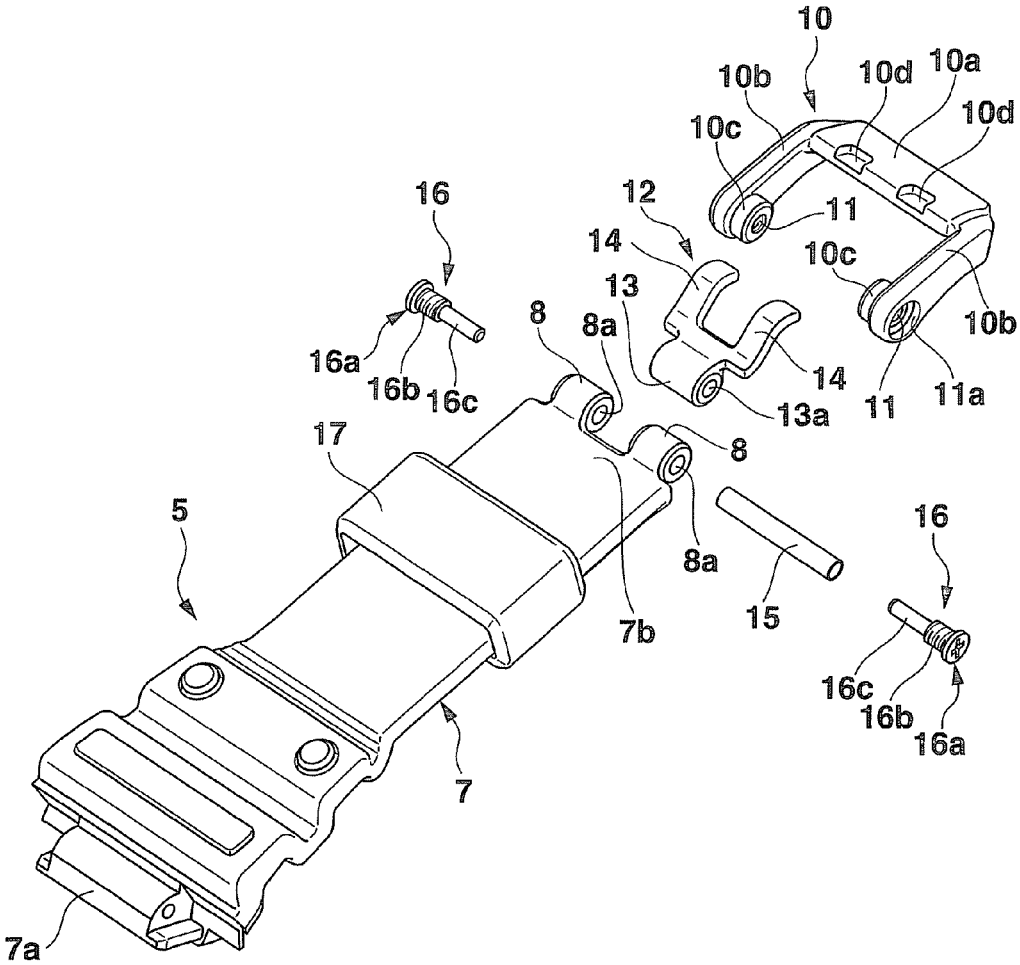
FIG. 4 is an explored perspective view of the band of FIG. 3.
Figure 5:
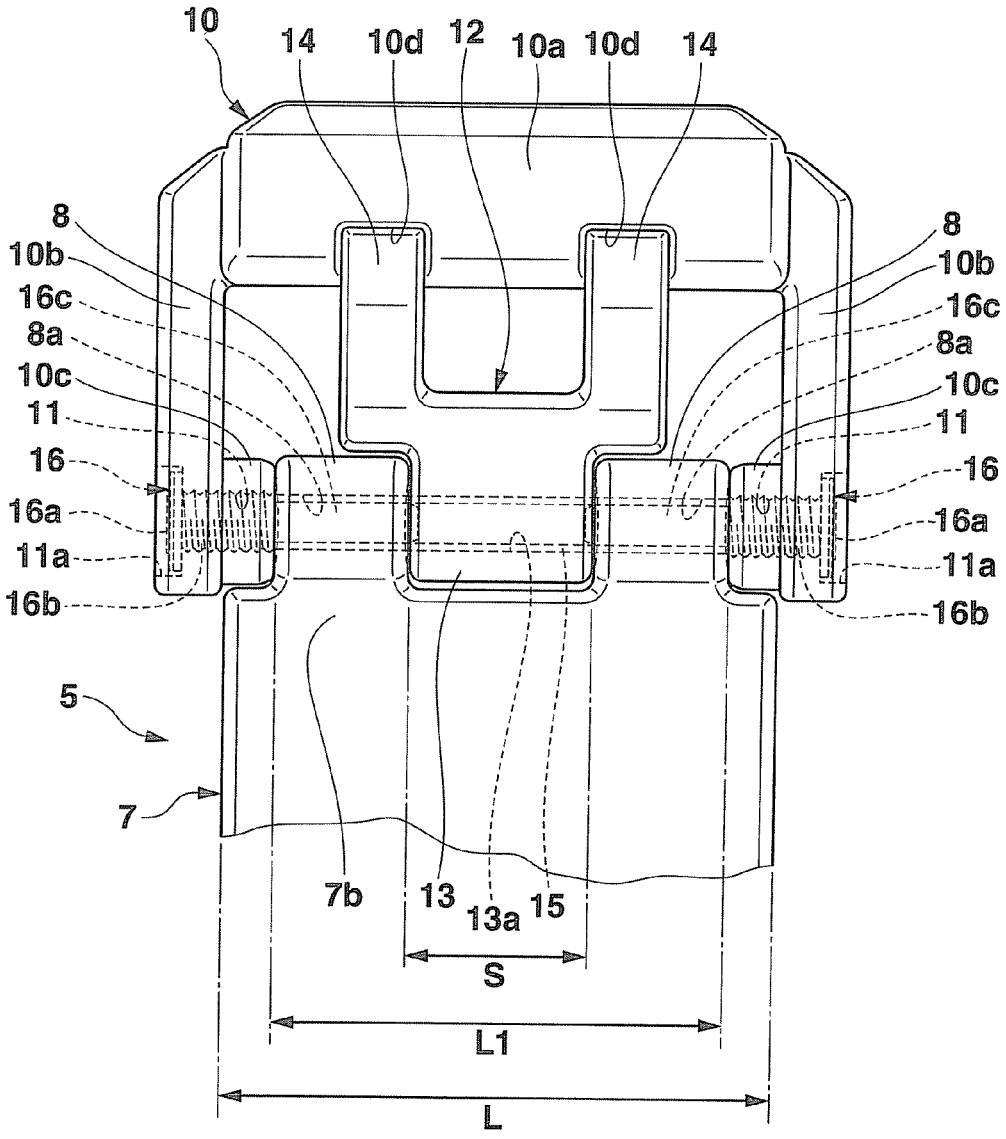
FIG. 5 is an enlarged front view of an essential part of the watch band of FIG. 3.

As shown in FIGS. 3-5, a pair of aligning attaching parts or sleeves 8, which are spaced by a distance S, are provided in aligning relationship at the other (or upper) end 7*b* of the band body 7 distal from the case 1 so as to extend perpendicular to the longitudinal direction of the band body 7 (FIG. 5).

As shown in FIGS. 4 and 5, the total width L1 of the pair of spaced attaching sleeves 8 and the space S present therebetween is smaller than the width L of the band body 7*b*.

As shown in FIGS. 3-5, a frame- or U-shaped buckle 10 is attached to a distal end 7*b* of the 12 o'clock side band body 7. The buckle 10 is made of a hard plastic resin or a metal such as stainless steel. The buckle 10 includes a strip-like base part 10*a* parallel to the band body end 7*b* and somewhat wider than the width L of the band body end 7*b*, and a pair of arms 10*b* extending parallel toward the band end 7*b* from both ends of the strip-like base part 10*a*.

As shown in FIGS. 3 and 5, the pair of arms 10*b* are disposed so as to hold the pair of attaching sleeves 8 between end portions of the arms 10*b*. As shown in FIG. 4, a pair of screw protrusions 10*c* which protrude in opposite directions are attached respectively to the inner ends of the pair of arms 10*b* such that screw holes 11 in the pair of screw protrusions 10*c* align with the respective through holes 8*a* in the pair of attaching sleeves 8.

As shown in FIGS. 4 and 5, the pair of arms 10*b* each also have a screw hole 11 extending through an end portion thereof communicating with a screw hole 11 in an associated screw protrusion 10*c*. Further, the pair of arms 10*b* each also have a counterbore 11*a* on the outside of the end portion thereof communicating with the screw hole 11 thereof so as to receive therein the head 16*a* of an associated screw 16 to be inserted, without protruding the head 16*a* of the screw 16 outside, as shown in FIGS. 3 and 5.

As shown in FIGS. 3-5, a substantially bifurcated engaging member 12 is attached rotatably to the end 7*b* of the band body 7. The engaging member 12 is made of a metal such as stainless steel and includes a connection part or sleeve 13 disposed between the pair of attaching parts or sleeves 8 of the band body 7, and a pair of parallel spaced engaging protrusions 14 extending from the base thereof to the base part 10*a* of the buckle 10. The connection sleeve 13 has a through hole 13*a* aligning with through holes 8*a* in the pair of attaching sleeves 8 between which the connection sleeve 13 is disposed.

As shown in FIGS. 3-5, the pair of parallel engaging protrusions 14 are adapted to be received at their free ends in corresponding recesses 10*d* provided on the buckle base 10*a* so as not to rotate any longer and shake horizontally, or in a direction perpendicular to the longitudinal direction of the band body 7.

As shown in FIGS. 3-5, the engaging member 12 is attached rotatably to the end of the band body 7 by a connection pipe 15 made of a metal such as stainless steel extending through the through holes 13*a* and 8*a* in the connection sleeve 13 of the engaging member 12 and the pair of spaced attaching sleeves 8 of the band body 7, which hold the connection sleeve 13 therebetween and align with the connection sleeve 13.

As shown in FIG. 5, the connection pipe 15 has a length substantially equal to or somewhat shorter than the total length L1 of the pair of attaching sleeves 8 and a space between these attaching sleeves 8 such that the connection sleeve 15 does not protrude outside from any one of the both ends of the through holes 8*a* in the pair of attaching sleeves 8.

As shown in FIGS. 3-5, the buckle 10 is attached rotatably to the end 7*b* of the band body 7 by a pair of screws 16 made of a metal such as stainless steel. The pair of screws 16 each comprise a head 16*a* exposed outside of a respective one of the pair of arms 10*b* of the buckle 10, a male thread part 16*b* screwed into a screw hole 11 of a screw protrusion 10*c* attached to the inside of an end portion of that arm 10*b*, and a shank part 16*c* extending into an associated end portion of the connection pipe 15.

In this case, as shown in FIG. 4, the head 16*a* has a larger diameter than the male thread part 16*b* so as not to protrude outside from the counterbore 11*a* provided in the outside of the end portion of the associated arm 10*b* when accommodated in the counterbore 11*a*. The male thread part 16*b* is screwed into the screw hole 11 in the screw protrusion 10*c* attached to the inside of the end portion of the associated arm 10*b*. The shank part 16*c* has a diameter smaller than the male thread part 16*b* and has an appropriate length to be inserted into the connection pipe 15.

More particularly, as shown in FIG. 5, the shank part 16*c* has a length sufficient to reach a nearer end of the connection sleeve 13 of the engaging member 12 within the connection pipe 15 when the male thread part 16*b* is screwed fully into the screw protrusion 10*c* provided on the inside of the end portion of the associated arm 10*b*.

Thus, as shown in FIGS. 3-5, the shank part 16*c* of the screw 16 is inserted into the connection pipe 15 through the screw hole 11 in the associated arm 10*b* from its outside and the thread part 16*b* is screwed into the screw hole 11 in the associated arm 16*b*. In this state, the head 16*a* of the screw 16 exposed outside the arm 10*b* is adapted to be turned for tightening purpose.

When the screw 16 is tightened sufficiently such that the shank part 16*c* is inserted sufficiently deeply into the connection pipe 15, the thread part 16*b* is engaged in the screw hole 11 in the associated arm 10*b* with the screw head 16*a* disposed within the counterbore 11*a* in the associated arm 10*b*, thereby attaching the buckle 10 to the end of the band body 7. As shown in FIGS. 1-4, a looped keeper 17 is provided so as to surround and be movable along the band body 7.

Then, attachment of the band 5 to the wristwatch case 1 will be described. As shown in FIGS. 3-5, the buckle 10 and the engaging member 12 are attached to the 12 o'clock side band body 7 such that the connection sleeve 13 of the engaging member 12 is disposed between the pair of attaching parts or sleeves 8 so as to cause the respective through holes 8*a* of the pair of attaching sleeves 8 to align with the hole 13*a* of the connection sleeve 13.

In the state shown in FIGS. 3-5, the connection pipe 15 is inserted into the respective through holes 8*a* in the pair of attaching sleeves 8 and the hole 13*a* in the connection sleeve 13 such that the connection pipe 15 does not protrude outside from any one of the outer ends of the pair of attaching sleeves 8, thereby attaching the engaging member 12 to the end 7*b* of the band body 7.

Then, the buckle 10 is attached to the end 7*b* of the band body 7. At this time, first, the respective screw protrusions 10*c* provided on the insides of the pair of arms 10*b* are disposed so as to hold the pair of attaching sleeves 8 therebetween in aligning relationship, thereby causing the screw hole 11 in the pair of screw protrusions 10*c* and the through holes 8*a* in the pair of attaching sleeves 8 to align with each other.

In this state, the screws 16 are inserted through the respective screw holes 11 in the end portions of the buckle arms 10*b* and their screw protrusions 10*c* into the connection pipe 15 from the respective outsides of the buckle arms 10*b* and are tightened. At this time, first, the shank parts 16*c* of the screws 16 are inserted into the screw holes 11 in the end portions of the pair of arms 10*b* of the buckle 10 from the respective outsides of the arms. The inserted shank parts 16*c* are further inserted into the connection pipe 15 from its opposite ends and the thread parts 16*b* of the screws 16 are screwed into the screw holes 11 in the end portions of the arms 10*b*.

At this time, when the screw heads 16*a* are turned to tighten the screws 16, the thread parts 16*b* are screwed into the respective screw holes 11 in the screw protrusions 10*c* attached to the insides of the end portions of the arms 10*b* with the screw heads 16*a* disposed within the counterbores 11*a* in the end portion of the arms 10*b* without protruding outside.

In this case, the screws 16 are inserted sufficiently deeply into the connection pipe 15 from its opposite ends such that the screw shank parts 16*c* reach the respective nearer ends of the connection sleeve 13 of the engaging member 12. Thus, the buckle 10 is attached rotatably to the pair of attaching sleeves 8 securely and stably by the screws 16.

Then, the 12 and 6 o'clock side band bodies 7 are attached to the respective opposite attaching parts 4 of the case 1 to allow same to be worn on the user's wrist.

At this time, the end portion 6*b* of the 6 o'clock side band body 6 is inserted into the buckle 10 attached to the end 7*b* of the 12 o'clock side band body 7 such that the pair of engaging protrusions 14 of the engaging member 12 are inserted into a pair of engaged eyelets selected from among the row of pairs of eyelets 6*c* provided in the band body 6.

When in this state the pair of engaging protrusions 14 are caused to contact the buckle base 10*a*, the engaging member 12 is restricted from rotating any longer around the connection sleeve 13. At this time, the pair of engaging protrusions 14 are disposed removably in the pair of position restricting recesses 10*d* provided on the buckle base 10*a* so that the engaging member 12 is restricted from shaking horizontally, or in a direction perpendicular to the longitudinal direction of the band body 7. Thus, the band 5 is worn well around the user's wrist without being loosened.

When the case 1 is worn by the band 5 on the user's wrist, the shank parts 16*c* of the screws 16 are inserted rotatably in the connection pipe 15 with the thread parts 16*b* of the screw 16 screwed into the screw holes 11 in the end portions of the arms 10*b* of the buckle 10. Thus, the buckle 10 can rotate smoothly around the screw shank part 16*c* without loosening the thread parts 16*b*. Thus, the end portion 6*b* of the 6 o'clock side band body 6 can easily be inserted into the buckle 10 attached to the 12 o'clock side band body 7, as requested.

When the wristwatch with the band 5 is dropped inadvertently from a height such as, for example, about-10 m-high story of a building, the buckle 10 can collide with an object such as the ground and get a great shock. At this time, the pair of arms 10*b* of the buckle 10 can be moved away from each other. Even in such a case, the buckle 10 does not slip off from the band body 7 because the shank parts 16*c* of the screws 16 whose thread parts 16*b* are screwed into the screwed holes 11 in the end portions of the arms 10*b* of the buckle 10 are inserted sufficiently deeply in the connection part 15 from its opposite ends.

That is, as shown in FIG. 5, the screw shank parts 16*c* have a length inserted sufficiently into the connection pipe 15 so as to reach a nearer end of the connection sleeve 13 of the engaging member 12. Thus, even when the pair of arms 10*b* are moved away from each other, the screw shank parts 16*c* do not slip off from the connection pipe 15 and hence the buckle 10 does not slip off from the band body 7.

As just described above, according to the wristwatch band 5, the pair of attaching sleeves 8 attached to the end 7*b* of the 12 o'clock side band body 7 and the connection sleeve 13 of the engaging member 12 disposed between the pair of attaching sleeves 8 are connected by the connection pipe 15. The buckle 10 is then disposed such that its arms 10*b* hold the pair of attaching sleeves 8 between the end portions thereof. In this state, the thread parts 16*b* of the screws 16 are screwed into the screw holes 11 in the end portions of the arms 10*b* of the buckle 10 such that the screw shank parts 16*c* are inserted deeply into the connection pipe 15, thereby attaching the buckle 10 rotatably to the band body 7. Thus, even when the buckle 10 gets a great shock from collision with an object such as the ground due to dropping thereof, the buckle 10 is prevented from slipping off from the band body 7.

That is, with this wristwatch band 5, even when the wristwatch case 1 with the band body 7 is dropped from a height such as, for example about-10-m-high story of a building, and the buckle 10 gets a great shock so that the pair of arms 10*b* of the buckle 10 are moved away from each other, the screw shank parts 16*c* do not slip off from the connection pipe 15 because the screw shank parts 16*c* screwed into the buckle 10 are inserted sufficiently deeply into the connection pipe 15 which attaches the engaging member 12 to the band body 7. Thus, the buckle 10 does not slip off from the band body 7.

In this case, the screw shank parts 16*c* are inserted into the connection pipe 15 so that the shank parts 16*c* reach the respective nearer ends of the connection sleeve 13 of the engaging member 12 disposed between the pair of attaching sleeves 8 of the band body 7. Thus, even when the buckle 10 gets a great shock, thereby causing the pair of arms 10*b* of the buckle 10 to be moved away from each other, the shank parts 16*c* do not slip off the connection pipe 15. Therefore, the buckle 10 is securely prevented from slipping off the band body 7 attached securely and stably to the band body 7.

The screw shank parts 16*c* are inserted rotatably in the connection pipe 15 with the thread parts 16*b* screwed into the screw holes 11 in the end portions of the pair of buckle arms 10*b* and their screw protrusions 10*c*. Thus, the buckle 10 can rotate smoothly around the respective screw shank parts 16*c* without loosening the thread parts 16*b*.

The screw shank parts 16*c* are inserted within the connection pipe 15. Thus, when the buckle 10 rotates around the shank parts 16*c*, the pair of attaching sleeves 8 are prevented from being worn away by the screw shank parts 16*c* rotating along with the buckle 10 although the pair of attaching sleeves 8 are made of a flexible plastic resin. Thus, the watch band is of high durability.

The screw shank parts 16*c* are inserted rotatably within the connection pipe 15. Thus, the end portion 6*b* of the 6 o'clock side band body 6 can be easily inserted into the buckle 10 attached to the 12 o'clock band body 7 by rotating the buckle 10, as required. Thus, the 6 o'clock side band end portion 6*b* can be easily and well connected to the 12 o'clock side band body 7, and will be a user-friendly watch band.

According to the watch band 5, the buckle 10 has the pair of screw protrusions 10*c* each provided on the inside of the end portion of an associated one of the arms 10*b* and protruding to an associated one of the pair of attaching sleeves 8 of the band body 7. The pair of arms 10*b* and the associated screw protrusions 10*c* attached thereto have the screw hole 11 extending therethrough into which the thread parts 16*b* of the screws 16 are screwed. Thus, even when each of the pair of buckle arms 10*b* has a thin thickness, the total length of the buckle arm and associated screw protrusion involving the screw holes 11 in the associated buckle arm and screw protrusion 10*c* is substantial. Thus, the thread parts 16*b* are firmly screwed in opposite directions into the respective arms 10*b* and screw protrusions 10*c* of the buckle 10 and hence the buckle 10 is stably and firmly attached to the band body 7 by the screws 16.

Each buckle arm 10*b* has the counterbore 11*a*, communicating and aligning with the screw hole 11 therein, on the outside thereof to receive the head 16*b* of the screw 16 which is screwed into the screw holes 11 in the buckle arm and the female protrusion concerned. The counterbore 11*a* is sufficiently large to accommodate the head 16*a* of the screw 16 therein such that when the thread part 16*b* is screwed and tightened in the screw holes 11 in the associated arm and screw protrusion of the buckle 10, the screw head 16*a* does not protrude outside from its counterbore.

Thus, the screw heads 16*a* do not directly get a great shock from collision with an object such as the ground due to dropping thereof. Therefore, the screws 16 is not free to rotate to loosen. Further, the screw heads 16*a* do not protrude outside from the buckle 10. Thus, the user can safely use the band which wears the watch on her wrist without allowing the screw heads 16*a* to hit and damage objects and/or persons.

The wristwatch of this embodiment has the case 1 within which the timepiece module 2 is accommodated and the band 5 attached to the case. Thus, the bands 5 can be easily attached to existing wrist watches and used well.

Embodiment 2

Figure 6:
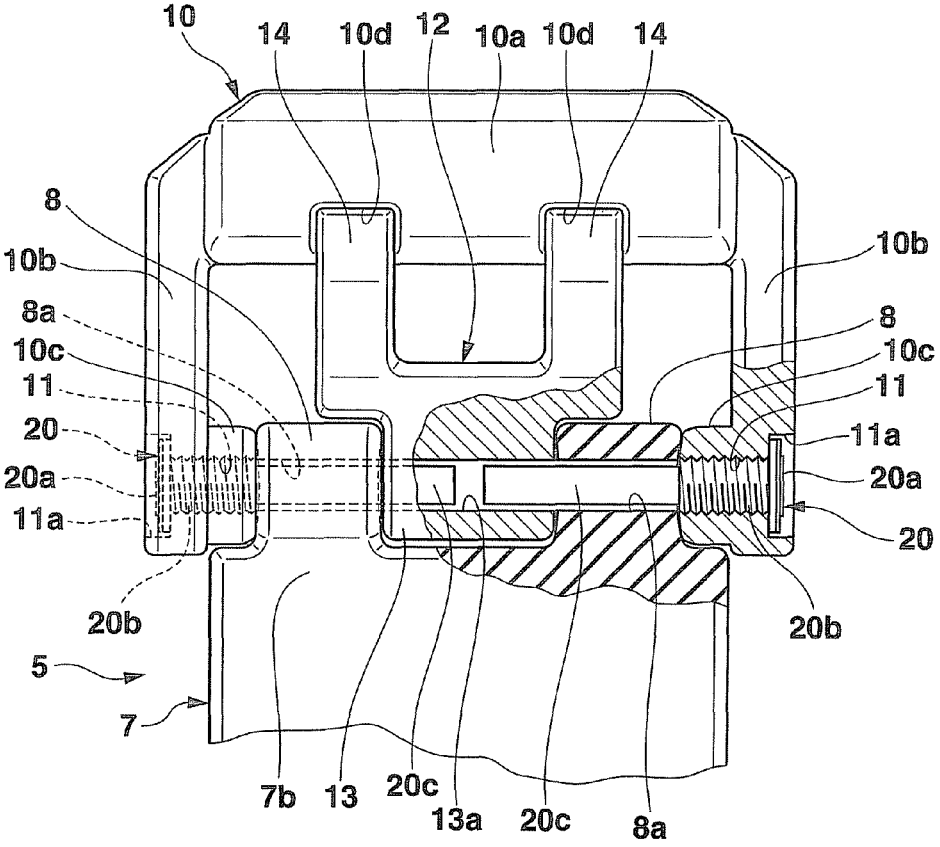
FIG. 6 is an enlarged front view of an essential part of a wristwatch band, which is shown partially in cross section for an illustration purpose, for a wristwatch of an embodiment 2 of the present invention.

Referring to FIG. 6, the embodiment 2 of the watch band 2 applied to the wristwatch will be described. As shown in FIG. 6, the band 5 has substantially the same structure as the embodiment 1 excluding that the buckle 10 and the engaging member 12 are attached to the band body 7 by a pair of screws 20 without using a connection pipe as shown by 15 in the embodiment 1.

As shown in FIG. 6, the screws 20 are made of a metal such as stainless steel. The screws 20 each include a head 20*a* exposed outside of an associated one of the pair of arms 10*b* of the buckle 10, a thread part 20*b* screwed into the screw holes 11 in the associated arm 10*b* and its screw protrusion 10*c*, and a shank part 20*c* inserted through the through hole 8*a* in an associated one of the pair of attaching sleeves 8 of the band body 7 and through the through hole 13*a* in the connection sleeve 13 of the engaging member 12.

In this case, as in the embodiment 1, the screw head 20*a* has a larger diameter than the thread part 20*b* and is disposed within the counterbore 11*a* provided on the outside of the end portion of the associated one of the pair of buckle arms 10*b* so as not to protrude outside from the arm 10*b*. The thread part 20*b* is adapted to be screwed into the screw hole 11 in the screw protrusion 10*c* provided on the associated arm 10*b*. The shank part 20*c* has a smaller diameter than the thread part 20*b*.

As shown in FIG. 6, the shank parts each 20*c* have a length reaching about a midpoint of the connection sleeve 13 of the engaging member 12 when the thread parts 20*b* are screwed into the screw holes 11 in the arms 10*b* and their screw protrusions 10*c*. Thus, the shank parts 20*c* are inserted rotatably through the through holes 8*a* in the attaching sleeves 8 of the band body 7 into the through hole 13*a* in the connection sleeve 13 of the engaging member 12, thereby attaching the buckle 10 and the engaging member 12 to the end 7*b* of the band body 7.

A method of attaching the buckle 10 and the engaging member 12 to the 12 o'clock side band body 7 of the band 5 will be described. As shown in FIG. 6, the connection sleeve 13 of the engaging member 12 is disposed between the pair of attaching parts or sleeves 8 of the band body 7 such that the respective through holes 8*a* of the pair of attaching sleeves 8 align with the through hole 13*a* in the connection sleeve 13.

In the state of FIG. 6, then, the buckle 10 is disposed at the end portion 7*b* of the band body 7 such that the screw protrusions 10*c* provided on the insides of the end portions of the pair of buckle arms 10*b* hold the pair of attaching sleeves 8 therebetween in aligning relationship.

Then, the screws 20 each are screwed from the outside of the associated arm 10*b* of the buckle 10 into the screw holes 11 in the associated buckle arm 10*b* and its screw protrusion 10*c*.

When in this state the screws 20 are tightened by turning their head 20*a*, the thread parts 20*b* are screwed into the screw holes 11 in the buckle arms 10*b* and their screw protrusions 10*c* and the screw heads 20*a* are disposed within the counterbores 11*a* in the arms 10*b* without protruding outside of the arms 10*b* as in the embodiment 1.

At this time, the screw shank parts 20*c* reach about a midpoint of the through hole 13*a* in the connection sleeve 13. In this case, the screws 20 are inserted into the through hole 13*a* in the connection sleeve 13 from the outside of the arms 10*b* of the buckle 10 such that the respective shank parts 20*c* do not contact each other at the midpoint of the through hole 13*a* in the connection sleeve 13. Thus, the shanks 10 and the engaging member 12 are securely attached rotatably within the pair of attaching sleeves 8 by the pair of screws 20.

As just describe above, according to the wristwatch band 5, the pair of attaching sleeves 8 are provided at the end 7*b* of the 12 o'clock side band body 7 and the connection sleeve 13 of the engaging member 12 is disposed between the pair of attaching sleeves 8. The arms 10*b* of the buckle 10 are disposed so as to hold the pair of attaching sleeves 8 between the opposite end portions thereof. Then, the thread parts 20*b* of the screws 20 are screwed into the screw holes 11 in the end portions of the buckle arms 10*b* with the shank parts 20*c* of the screws 20 inserted into the through holes 8*a* of the attaching sleeves 8 of the band body 7 and the hole 13*a* in the connection sleeve 13, thereby attaching the buckle 10 and the engaging member 12 to the band body 7. Thus, like the embodiment 1, the buckle 10 does not slip off from the band 7 even when getting a great shock from collision with an object such as the ground due to dropping thereof.

That is, also, with this wristwatch band 5, even when the wristwatch case 1 with the band body 7 is dropped from a height such as, for example, an about-10-m-high story of a building, and the buckle 10 gets a great shock from collision with an object such as the ground so that the pair of arms 10*b* of the buckle 10 are moved away from each other, the screw shank parts 20*c* do not slip off from the holes 8*a* of the attaching sleeves 8 attached to the band body 7 because the shank parts 20*c* of the screws 20 screwed into the screw holes 11 in the buckle arms 10*b* and their screw protrusions 10*c* are inserted sufficiently deeply into the connection sleeve 13 of the engaging member 12 through the through holes 8*a* of the pair of attaching sleeves 8. Thus, the buckle 10 is prevented from slipping off from the band body 7.

In this case, the screw shank parts 20*c* has a length reaching about a midpoint of the connection sleeve 13 of the engaging member 12 disposed between the pair of attaching sleeves 8 of the band body 7. Thus, even when the buckle 10 gets a great shock from collision with an object such as the ground, thereby causing the pair of arms 10*b* of the buckle 10 to be moved away from each other, the shank parts 20*c* do not slip off from the connection sleeve 13. Therefore, the buckle 10 and the engaging member 12 are securely prevented from slipping off from the band body 7 and the buckle and the engaging member 12 are attached securely and stably to the band body 7.

The shank parts 20*c* of the screws 20 are inserted rotatably within the attaching sleeves 8 of the band body 7 and the connection sleeve 13 of the engaging member 12 with the thread parts 20*b* of the screws 20 screwed into the screw holes 11 in the buckle arms 10*b* and their screw protrusions 10*c*. Thus, the buckle 10 can rotate smoothly around the shank parts 20*c* of the screws 20 along with the engaging member 12 without causing the thread parts 20*b* to loosen, as required.

Summary of the Embodiments 1 and 2

As shown in FIGS. 1-5, the watch band of the embodiment 1 comprises a band body (7) with a pair of spaced attaching parts (8), each having a through hole (8*a*), provided at an end of the band body such that the through holes in the pair of attaching parts align with each other; a frame-shaped buckle (10) having a pair of spaced arms (10*b*) disposed so as to hold the pair of attaching parts therebetween, the arms each having a through screw hole (11) in an end portion of that arm with the through screw holes aligning with the through holes in the pair of attaching parts; an engaging member (12) disposed between the pair of attaching parts, the engaging member protruding in the longitudinal direction of the band body, the engaging member having a though hole (13*a*) aligning with the through holes (8*a*) in the pair of attaching parts; a connection pipe (15) inserted through the through holes (8*a*) in the pair of attaching parts (8) and through the through holes (13*a*) in the engaging member (12) for attaching the engaging member (12) to the band body (7); and a pair of screws (16) for attaching the buckle to the band body, each screw having a head exposed outside from a screw hole in an end portion of an associated one of the pair of arms of the buckle, a thread portion (16*b*) screwed into the screw hole in the end portion of the associated arm of the frame-shaped buckle and a shank part (16*c*) inserted rotatably in the connection pipe.

As shown in FIG. 6, the watch band of the embodiment 2 comprises a band body (7) with a pair of spaced attaching parts (8), each having a through hole (8*a*), provided at an end of the band body such that the through holes in the pair of attaching parts align with each other; a frame-shaped buckle (10) having a pair of spaced arms (10*b*) disposed so as to hold the pair of attaching parts therebetween, the arms each having a through screw hole (11) in an end portion of that arm with the through screw holes aligning with the through holes in the pair of attaching parts; an engaging member (12) disposed between the pair of attaching parts, the engaging member protruding in the longitudinal direction of the band body, the engaging member having a though hole (13*a*) aligning with the through holes (8*a*) in the pair of attaching parts; and a pair of screws (16, 20) for attaching the buckle and the engaging member to the band body, each screw having a head (16*a*, 20*a*) exposed outside from a screw hole in an end portion of an associated one of the pair of arms of the buckle, a thread portion (16*b*, 20*b*) screwed into the screw hole in the end portion of the associated one of arms of the frame-shaped buckle and a shank part (16*c*, 20*c*) inserted rotatably into the though holes of the pair of attaching parts and the through hole of the engaging member.

In the watch band of the embodiment 1 (FIGS. 1-5), the shank part (16*c*, 20*c*) of each screw (16, 20) has a length reaching a nearer end of the engaging member (12) disposed between the pair of attaching parts (8) provided at the band body (7). The pair of arms of the buckle (10) each have a screw protrusion (10*c*) provided on the inside of the end portion thereof protruding toward a nearer one of the pair of attaching parts (8) provided on the band end in aligning relationship, each screw protrusion having a through screw hole (11) aligning with the through holes in the pair of attaching parts.

Each of the pair of arms of the buckle (10) has a counterbore (11*a*) on the outside of the end thereof in which the head (16*a*, 20*a*) of the associated screw (16, 20) is disposed. A wristwatch (FIGS. 1-5) comprises the wristwatch band (5) and a watch case (1) connected to the wristwatch band.

Although in the embodiments 1 and 2 the engaging member 12 attached rotatably to the pair of attaching sleeves 8 of the band body 7 is illustrated as being Y-shaped or bifurcated from the connection sleeve 13 thereof, the engaging member 12 need not be Y-shaped or bifurcated. Instead, the connection sleeve 3 may have a single engaging protrusion extending therefrom toward the base part 10*a* of the buckle 10.

Various modifications and changes may be made thereunto without departing from the broad spirit and scope of this invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A watch band comprising a band body with a pair of spaced attaching parts, each having a through hole, provided at an end of the band body such that the through holes in the pair of attaching parts align with each other;

a frame-shaped buckle having a pair of spaced arms disposed so as to hold the pair of attaching parts therebetween, the arms each having a through screw hole in an end portion of that arm with the through screw holes aligning with the through holes in the pair of attaching parts;

an engaging member disposed between the pair of attaching parts, the engaging member protruding in the longitudinal direction of the band body, the engaging member having a though hole aligning with the through holes in the pair of attaching parts;

a connection pipe inserted through the through holes in the pair of attaching parts and through the through holes in the engaging member for attaching the engaging member to the band body; and a pair of screws for attaching the buckle to the band body, each screw having a head exposed outside from a screw hole in an end portion of an associated one of the pair of arms of the buckle, a thread portion screwed into the screw hole in the end portion of the associated arm of the frame-shaped buckle and a shank part inserted rotatably in the connection pipe.

2. A watch band comprising a band body with a pair of spaced attaching parts, each having a through hole, provided at an end of the band body such that the through holes in the pair of attaching parts align with each other;

a frame-shaped buckle having a pair of spaced arms disposed so as to hold the pair of attaching parts therebetween, the arms each having a through screw hole in an end portion of that arm with the through screw holes aligning with the through holes in the pair of attaching parts;

an engaging member disposed between the pair of attaching parts, the engaging member protruding in the longitudinal direction of the band body, the engaging member having a though hole aligning with the through holes in the pair of attaching parts;

a connection pipe inserted into the through holes of the pair of attaching parts and the through hole of the engaging member to attach the engaging member to the pair of attaching parts of the band body; and a pair of screws, each screw having a head exposed outside an end portion of an associated one of the pair of arms of the buckle, a thread portion screwed into the screw hole in the end portion of the associated one of arms of the frame-shaped buckle and a shank part inserted rotatably into the connection pipe, the pair of screws attaching the buckle and the engaging member to the band body through the connection pipe.

3. The watch band of claim 1, wherein the shank part of each screw has a length reaching a nearer end of the engaging member disposed between the pair of attaching parts provided at the band body.

4. The watch band of claim 1, wherein the pair of arms of the buckle each have a screw protrusion provided on the inside of an associated arm protruding toward a nearer one of the pair of attaching parts provided on the band end in aligning relationship, each screw protrusion having a through screw hole aligning with the through holes in the pair of attaching parts.

5. The watch band of claim 4, wherein each of the pair of arms of the buckle has a counterbore on the outside thereof in which the head (16*a*, 20*a*) of the associated screw is disposed.

6. A wristwatch comprising the wristwatch band of claim 1 and a watch case connected to the wristwatch band.

7. A wristwatch comprising the wristwatch band of claim 2 and a watch case connected to the wristwatch band.

* * * * *